US009623475B2

(12) United States Patent
Hirata et al.

(10) Patent No.: US 9,623,475 B2
(45) Date of Patent: Apr. 18, 2017

(54) METHOD FOR PRODUCING SPRING

(75) Inventors: Yuichi Hirata, Nagoya (JP); Hidekazu Suzuki, Nagoya (JP); Hiroyuki Ogiso, Nagoya (JP)

(73) Assignee: CHUO HATSUJO KABUSHIKI KAISHA, Nagoya (JP)

( * ) Notice: Subject to any disclaimer, the term of this patent is extended or adjusted under 35 U.S.C. 154(b) by 871 days.

(21) Appl. No.: 13/812,138

(22) PCT Filed: Jul. 12, 2011

(86) PCT No.: PCT/JP2011/065886

§ 371 (c)(1),
(2), (4) Date: Jan. 24, 2013

(87) PCT Pub. No.: WO2012/014672

PCT Pub. Date: Feb. 2, 2012

(65) Prior Publication Data

US 2013/0119045 A1 May 16, 2013

(30) Foreign Application Priority Data

Jul. 26, 2010 (JP) ..... 2010-166806

(51) Int. Cl.
*B21F 35/00* (2006.01)
*C21D 9/02* (2006.01)
(Continued)

(52) U.S. Cl.
CPC ..... *B21F 35/00* (2013.01); *B21F 99/00* (2013.01); *C21D 1/26* (2013.01); *C21D 1/40* (2013.01); *C21D 9/02* (2013.01); *Y10T 29/49609* (2015.01)

(58) Field of Classification Search
CPC .. B21F 35/00; C21D 1/40; C21D 9/02; Y10T 29/49609
See application file for complete search history.

(56) References Cited

U.S. PATENT DOCUMENTS 2,105,105 A * 1/1938 Zimmerman ..... 219/50
2,254,525 A * 9/1941 Hathaway ..... 219/50
(Continued)

FOREIGN PATENT DOCUMENTS

CN 1068371 A 1/1993
CN 1194187 A 9/1998
(Continued)

OTHER PUBLICATIONS

Office Action dated Nov. 11, 2013 in Chinese Patent Application No. 201180036389, partial English translation, 8 pages.
(Continued)

*Primary Examiner* — David Angwin
*Assistant Examiner* — John J Norton
(74) *Attorney, Agent, or Firm* — Vierra Magen Marcus LLP

(57) ABSTRACT

A method of producing a spring which reduces time required for a heat treatment step of eliminating a machining strain generated by a forming step is provided. This production method is provided with a forming step (S10) of forming a spring steel material into a spring shape and a heat treatment step (S12) of eliminating a machining strain generated in the spring steel material by the forming step. The heat treatment step is executed by electrically heating the spring steel material by applying a current thereto. The heat treatment step has a first step of heating the spring steel material to a predetermined set temperature and a second step of keeping the spring steel material at the set temperature for a predetermined set time period subsequent to the first step. The set temperature is set to be higher than 430° C. but not higher than 500° C.

4 Claims, 4 Drawing Sheets

(51) Int. Cl.

| | |
|---|---|
| ***B21F 99/00*** | (2009.01) |
| ***C21D 1/26*** | (2006.01) |
| ***C21D 1/40*** | (2006.01) |

(56) References Cited

U.S. PATENT DOCUMENTS

| | | | | |
|---|---|---|---|---|
| 2,666,723 | A * | 1/1954 | Stewart | 148/580 |
| 3,311,733 | A * | 3/1967 | Bitzer, Jr. | 219/50 |
| 3,890,687 | A * | 6/1975 | Goldberg | B21F 35/02 29/450 |
| 3,891,823 | A * | 6/1975 | Dulude | B23P 19/048 219/153 |
| 3,935,413 | A * | 1/1976 | Lesko | B21F 3/00 219/153 |
| 4,701,589 | A * | 10/1987 | Larsson | C21D 1/40 219/497 |
| 6,235,131 | B1 | 5/2001 | Keihle et al. | |
| 6,346,157 | B1 * | 2/2002 | Takezawa | C21D 7/06 148/580 |
| 6,470,725 | B1 * | 10/2002 | Boschiero | B21F 3/02 72/138 |
| 6,544,360 | B1 * | 4/2003 | Tange | C21D 7/06 148/580 |
| 2003/0122454 | A1 * | 7/2003 | Omata | H01L 41/09 310/367 |
| 2003/0158620 | A1 * | 8/2003 | Hasegawa | B21F 3/02 700/165 |
| 2005/0001367 | A1 * | 1/2005 | Taya | H02N 2/10 267/166 |
| 2005/0056066 | A1 * | 3/2005 | DeFranks | B21C 47/18 72/133 |
| 2008/0257003 | A1 * | 10/2008 | Bordignon | B21F 3/04 72/138 |
| 2010/0320662 | A1 * | 12/2010 | Tange | C21D 7/06 267/286 |
| 2011/0031666 | A1 * | 2/2011 | Warner | 267/166 |
| 2011/0232810 | A1 * | 9/2011 | Yajima et al. | 148/580 |

FOREIGN PATENT DOCUMENTS

| | | | |
|---|---|---|---|
| CN | 201381348 | Y | 1/2010 |
| JP | 55091946 | | 7/1980 |
| JP | 61030246 | | 2/1986 |
| JP | 61064812 | | 4/1986 |
| JP | 1184234 | | 7/1989 |
| JP | 2002178077 | A | 6/2002 |
| JP | 2003105498 | | 4/2003 |
| JP | 2008190042 | A | 8/2008 |
| JP | 2008248355 | | 10/2008 |

OTHER PUBLICATIONS

English Abstract of CN1068371, published Jan. 27, 1993,1 page.
English Abstract of CN1194187, published Sep. 30, 1998,1 page.
English Abstract and Machine Translation of 2002178077, published Jun. 25, 2002, 7 pages.
English Abstract of CN201381348, published Jan. 13, 2010,1 page.
Office Action dated Jul. 3, 2014 in Chinese Patent Application No. 201180036389, with partial English translation, 9 pages.
PCT International Preliminary Report on Patentability (Japanese) dated Jan. 29, 2013 in PCT Patent Application No. PCT/JP2011/065886, [online] retrieved from the Internet Apr. 11, 2013: http://patentscope.wipo.int/search/docservicepdf_pct/id00000020088400.pdf, 6 pages.
English translation of PCT International Preliminary Report on Patentability dated Feb. 12, 2013 in PCT Patent Application No. PCT/JP2011/065886, [online] retrieved from the Internet Apr. 11, 2013 : http://patentscope.wipo.int/search/docservicepdf_pct/id00000020088400.pdf, 8 pages.
English translation of PCT International Preliminary Report on Patentability dated Feb. 12, 2013 in PCT Patent Application No. PCT/JP2011/065886, 7 pages.
PCT International Search Report, dated Oct. 18, 2011, PCT/JP2011/065886.
PCT Written Opinion, dated Oct. 18, 2011, PCT/JP2011/065886.
Spring, Maruzen, Co., Ltd. 4th edition, Japan Society of Spring Engineers, 2008, pp. 463-466.
English Translation of Abstract of Japanese Patent Application No. JP2008248355.
Machine Translation of Japanese Patent Application No. JP2008248355 prepared by the Japanese Patent Office.
English Translation of Abstract of Japanese Patent Application No. JP61064812.
English Translation of Abstract of Japanese Patent Application No. JP61030246.
English Translation of Abstract of Japanese Patent Application No. JP55091946.
English Translation of Abstract of Japanese Patent Application No. JP1184234.
English Translation of Abstract of Japanese Patent Application No. JP2003105498.
Machine Translation of Japanese Patent Application No. JP2003105498 prepared by the Japanese Patent Office.
Office Action with English translation dated Apr. 21, 2015 in Japanese Patent Application No. 2012-526411, 6 pages.
English Abstract and Machine Translation of Japanese Publication No. JP2008190042, published Aug. 21, 2008.

* cited by examiner

METHOD FOR PRODUCING SPRING

TECHNICAL FIELD

The present application relates to a technology for producing a spring. Particularly, the present application relates to a technology for reducing time required for a heat treatment for eliminating a machining strain generated in a spring steel material.

BACKGROUND ART

Plastic working (e.g., bending, twisting) on a spring steel material to form the spring steel material into a spring shape generates a machining strain in the spring steel material. Due to an adverse effect of the machining strain on spring characteristics (e.g., durability, setting resistance), a heat treatment (a so-called "low temperature annealing treatment") for eliminating the machining strain of the spring steel material is executed after forming the spring steel material into a spring shape (Japan Society of Spring Engineers, "Spring," $4^{th}$ edition, P. 463 to 466, Maruzen Co., Ltd.). This heat treatment normally uses a heating furnace such as a hot-blast stove or an infrared heating furnace. In a case where the heat treatment is executed using such heating furnace, the spring steel material formed into the spring shape is introduced into the heating furnace from its one end. The spring steel material introduced in the heating furnace is heated while being conveyed toward the other end of the heating furnace, and carried out from the other end of the heating furnace to the outside of the heating furnace. The spring steel material is subjected to the heat treatment in this manner, and consequently the machining strain is eliminated from the spring steel material. It should be noted in this heat treatment that the treatment temperature is generally set at 380 to 430° C. and the treatment time at 20 to 60 minutes.

SUMMARY OF INVENTION

Technical Problem

When producing springs in a line production system (i.e., when mass-producing springs), a step of forming a spring steel material into a spring shape is executed, and then the formed spring steel material is conveyed to a heat treatment step where a heat treatment is executed. A problem of a conventional production method is that the heat treatment step requires longer time than the forming step. In other words, in the conventional production method, while the forming step requires 4 to 60 seconds, the heat treatment step requires 20 to 60 minutes. This means that a large number of workpiece materials are subjected to the heat treatment step simultaneously when the springs are produced in accordance with the time required in the forming step. For instance, when the forming step requires 30 seconds and the heat treatment step requires 30 minutes, one spring steel material is subjected to the heat treatment step every 30 seconds, generating 60 spring steel materials simultaneously in the heat treatment step. Therefore, a large heating furnace needs to be used for the heat treatment, lowering the heating efficiency. An object of the present application is to provide a technology capable of reducing the time required for the heat treatment step of eliminating the machining strain caused by the forming step.

Solution to Technical Problem

The present specification discloses a method of producing a spring. This production method comprises a forming step of forming a spring steel material into a shape of a spring (a predetermined shape) and a heat treatment step of eliminating a machining strain generated in the spring steel material by the forming step. The heat treatment step is executed by electrically heating the spring steel material by applying a current thereto, and comprises a first step of heating the spring steel material to a predetermined set temperature, and a second step of keeping the spring steel material at the set temperature for a predetermined set time period subsequent to the first step. The set temperature is set to be higher than 430° C. but not higher than 500° C. The set temperature herein means a temperature of a surface of the spring steel material where the current flows.

This production method electrically heats the spring steel material and can therefore heat the spring steel material to the set temperature within a short period of time. Furthermore, the heat treatment temperature (set temperature) of the spring steel material is set to be higher than 430° C. but not higher than 500° C., which is higher than the conventional heat treatment temperature (380 to 430° C.). For these reasons, the machining strain that is generated in the spring steel material in the forming step can be eliminated within a short period of time, so that the heat treatment step can be executed within a short period of time.

The set temperature is set to be higher than 430° C. but not higher than 500° C. for the following reason. When the set temperature is 430° C. or lower, the time required in the heat treatment cannot be made short enough. On the other hand, the set temperature exceeding 500° C. transforms the structure of the spring steel material and changes its mechanical characteristics.

In the production method described above, it is preferred that the set temperature be set such that time required in the first and second steps is 1 minute or less and the set time period required in the second step is 5 seconds or more. This configuration can reduce the difference in required time between the forming step and the heat treatment step and efficiently produce the spring.

It is preferred that, in the heat treatment step, a temperature of the spring steel material is measured and an amount of the current applied to the spring steel material and time required for applying the current are controlled based on the measured temperature. Although a desired level of heat treatment can be performed within a short period of time by increasing the heat treatment temperature (the set temperature), the more the heat treatment temperature fluctuates, the more the level of heat treatment fluctuates. Therefore, an appropriate level of heat treatment can be performed on the spring steel material by controlling the amount of the current and the time required in the application of the current, based on the measured temperature of the spring steel material.

The present specification further discloses a device capable of suitably heating a coil spring electrically. This electrical heating device comprises a first clamping mechanism that comprises a first electrode capable of being connected electrically to one end of the coil spring and is capable of clamping the one end of the coil spring, a second clamping mechanism that comprises a second electrode capable of being connected electrically to the other end of the coil spring and is capable of clamping the other end of the coil spring, and a power unit that applies a voltage between the first electrode and the second electrode. At least one of the first clamping mechanism and the second clamping mechanism is capable of moving in an axial direction of the coil spring and rotating around an axis of the coil spring with respect to the other of the first clamping mechanism and the second clamping mechanism. In this device, even when the coil spring is thermally deformed due to the electric heat, one of the clamping mechanisms becomes displaced with respect to the other clamping mechanism, preventing an excessive stress acting on the coil spring.

DESCRIPTION OF EMBODIMENTS

A method for producing a spring according to an embodiment will be described. In the present embodiment, the method for producing an automotive suspension coil spring (referred to as "suspension coil spring," hereinafter), which is a type of spring, will be described as an example. The suspension coil spring is to be disposed between a vehicle body and a wheel and generates force for pressing the wheel against a road surface. The suspension coil spring is produced by forming a spring steel material into a spiral shape. A spring wire rod that has a constant sectional area of its cross section perpendicular to an axial direction can be used as the spring steel material. Examples of the spring wire rod include an oil tempered wire having a wire diameter of $\phi 3$ to 20 mm (SUP12 (JIS G 4801), SWOSC-B (JIS G 3560), etc.).

Figure 1:
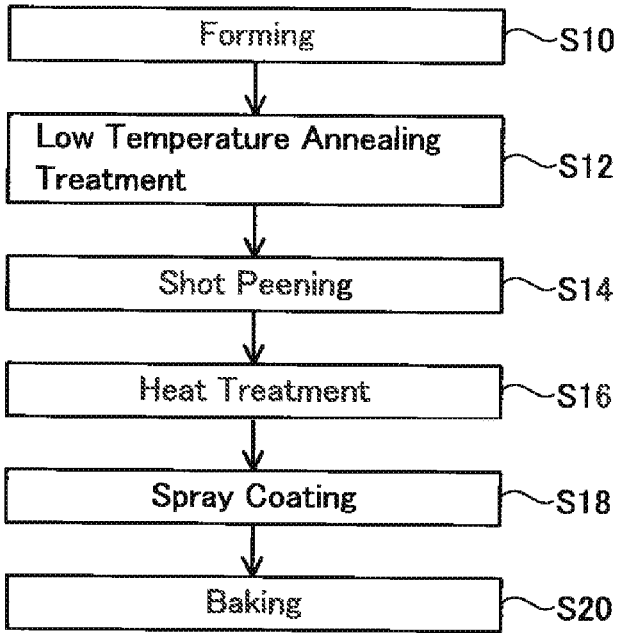
FIG. 1 is a flowchart showing a method of producing a spring according to an embodiment.
Figure 2:
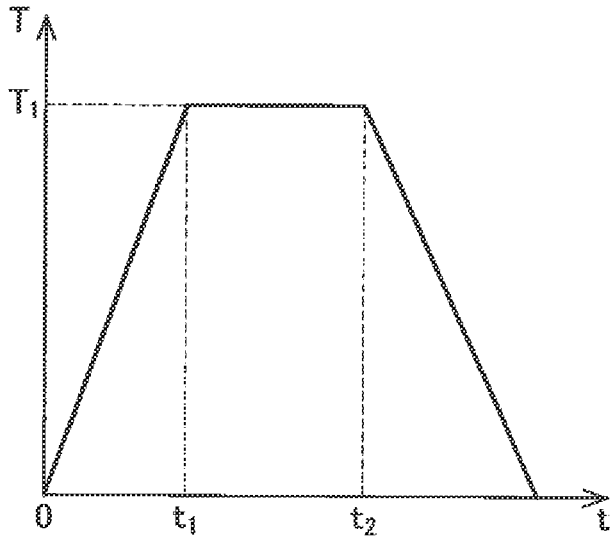
FIG. 2 is a diagram schematically showing a temperature profile obtained during step S12 of FIG. 1.

In order to produce the suspension coil spring, first, the spring steel material is subjected to cold or warm bending and then formed into a spiral shape, as shown in FIG. 1 (S10). A lead screw system where a spring steel material is wrapped around a core bar (a lead screw) with a groove or an NC coiling system in which a guide roller is used can be employed for forming the spring steel material. This forming step of step S10 generates a machining strain in the spring steel material.

Subsequently, a heat treatment (a low temperature annealing treatment) is executed on the spring steel material formed in the spiral shape (S12). This heat treatment is performed by electric heat. The electric heat applies a current to the spring steel material to be treated, thereby heating the spring steel material. The use of electric heat can heat the spring steel material to a desired temperature within a short period of time. The use of the spring wire rod with the constant cross-sectional area as the spring steel material of the suspension coil spring can evenly heat the entire spring steel material, and therefore the heat treatment can be performed evenly on the entire spring steel material.

The heat treatment of step S12 has a first step (0 to $t_1$) of heating the spring steel material to a predetermined set temperature $T_1$ and a second step ($t_1$ to $t_2$) of keeping the spring steel material having been heated to the set temperature $T_1$ at the set temperature $T_1$ for a predetermined set time period. When the second step is ended (i.e., when the heat treatment of step S12 is ended), the current flowing through the spring steel material is shut off, and accordingly the spring steel material is cooled naturally (from $t_2$ and thereon).

The set temperature $T_1$ described above is set to be higher than 430° C. but not higher than 500° C. Setting the set temperature higher than 430° C. can heat the spring steel material to a temperature higher than the conventional heat treatment temperature (380 to 430° C.) and end the heat treatment within a short period of time. On the other hand, setting the set temperature at 500° C. or lower can prevent the structure of the spring steel material from being transformed and the mechanical characteristics of the spring steel material from being changed by the heat treatment.

Figure 5:
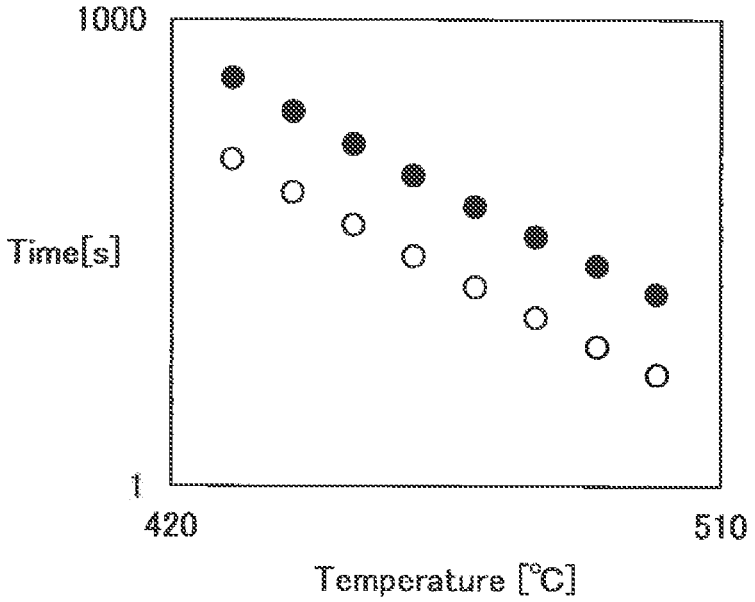
FIG. 5 is a diagram showing a relationship between a heat treatment temperature and time, which is obtained when the level of heat treatment (residual stress and hardness that result after a heat treatment) is the same.

Furthermore, the set temperature $T_1$ is set in accordance with the time period (0 to $t_2$) in which the heat treatment of step S12 is executed. FIG. 5 shows heat treatment conditions under which residual stress and hardness of the thermally treated spring steel material (SUP 12) are equal to each other (i.e., conditions under which the same amount of beat treatment is performed on the spring steel material). In the diagram, the values of the residual stress and the hardness obtained after the heat treatment are different from each other between ○ and ●, while the values of the residual stress and the hardness are equal to each other between ○ and ○ as well as between ● and ●. As is clear from FIG. 5, when the heat treatment temperature increases, the treatment time period decreases. Therefore, when reducing the treatment time period, the heat treatment temperature (set temperature $T_1$) is preferably increased. When lengthening the treatment time period, the heat treatment temperature (set temperature $T_1$) is preferably lowered. Thus, by setting the heat treatment time period in step S12 first and then setting the set temperature $T_1$ in accordance with the set heat treatment time period, an appropriate amount of heat treatment can be executed on the spring steel material for the set heat treatment time period. Note that the heat treatment time period is preferably determined in step S12 in accordance with the time required in the forming step of step S10. By determining the heat treatment time period in this manner, the number of forming devices can be balanced with the number of heat treatment devices.

For example, the heat treatment time period can be set in step S12 and the set temperature $T_1$ can be set in accordance with this set time period, such that the time period required in the first and second steps (0 to $t_2$) is 1 minute or less and the time period required in the second step ($t_1$ to $t_2$) is 5 seconds or more. Setting the time period required in the first and second steps to be 1 minute or less can make the time period required in the forming process of step S10 be equal to the time period required in the heat treatment of step S12 or reduce the difference therebetween. As a result, the number of heat treatment devices disposed in a production line for mass-producing suspension coil springs can be reduced. A specific example will now be described. Suppose that a forming device produces one coil spring every 30 seconds. In this case when it takes 5 minutes for a heat treatment device to thermally treat one coil spring, ten heat treatment devices are required per forming device. On the other hand, when it takes 1 minute for the heat treatment device to thermally treat one coil spring, only two heat treatment devices may be required per forming device, achieving a reduction in the number of heat treatment devices required.

Figure 3:
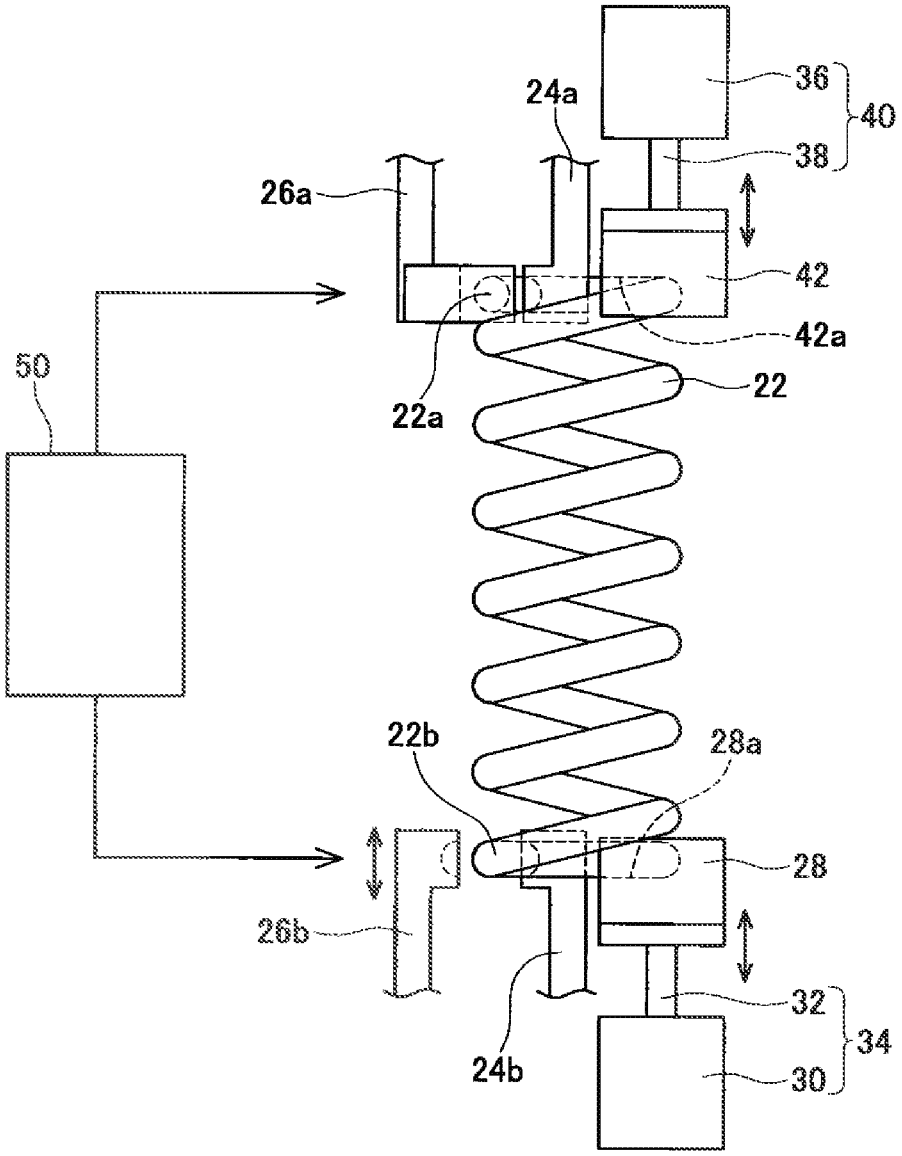
FIG. 3 is a side view schematically showing an electrical heating device that can be used in the process of step S12.
Figure 4:
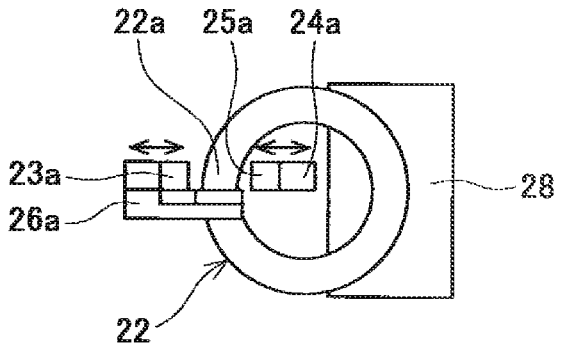
FIG. 4 is a plan view of the electrical heating device shown in FIG. 3.

An example of an electrical heating device used in the heat treatment of step S12 will now be described. As shown in FIGS. 3 and 4, the electrical heating device has a clamping mechanism (24*a*, 26*a*) for clamping an upper end 22*a* of a spring steel material 22, a clamping mechanism (24*b*, 26*b*) for clamping a lower end 22*b* of the spring steel material 22, and a power unit 50.

The clamping mechanism (24*a*, 26*a*) has clamping members 24*a*, 26*a*. As shown in FIG. 4, electrodes 25*a*, 23*a* are attached to the clamping members 24*a*, 26*a*. Contact surfaces following the shape of the spring steel material 22 are formed on the electrodes 25*a*, 23*a*. The electrodes 25*a*, 23*a* are connected to the power unit 50.

The clamping members 24*a*, 26*a* are moved by an actuator, not shown, between a position where these clamping members are close to each other (a clamping position) and a position where these clamping members are separated from each other (an open position). When the clamping members 24*a*, 26*a* are moved to the clamping position, the upper end 22*a* of the spring steel material 22 is clamped by the electrodes 25*a*, 23*a*. As a result, the spring steel material 22 is electrically connected to the electrodes 25*a*, 23*a*. When, on the other hand, the clamping members 24*a*, 26*a* are moved to the open position, the upper end 22*a* of the spring steel material 22 and the electrodes 25*a*, 23*a* enter a non-contact state. Note that the clamping mechanism (24*a*, 26*a*) is capable of rotating around an axis of winding of the spring steel material 22 (i.e., an axis of the suspension coil spring). Therefore, even when the spring steel material 22 is deformed as a result of the electrical heating, the clamping mechanism can deal with such deformation.

The clamping mechanism (24*b*, 26*b*) for clamping the lower end of the spring steel material 22 has substantially the same configuration as the clamping mechanism (24*a*, 26*a*) described above. However, unlike the clamping mechanism (24*a*, 26*a*), the clamping mechanism (24*b*, 26*b*) is driven in a vertical direction of FIG. 3 by an actuator that is not shown. Driving the clamping mechanism (24*b*, 26*b*) in the vertical direction can realize the installation and removal of the spring steel material 22 into and from the electrical heating device. As with the clamping mechanism (24*a*, 26*a*) described above, the clamping mechanism (24*b*, 26*b*) can be moved between the clamping position and the open position by the actuator that is not shown, and can be rotated around the axis of winding of the spring steel material 22.

As shown in FIGS. 3 and 4, the electrical heating device has a jig 28 for supporting the lower end 22*b* of the spring steel material 22 and a jig 42 for supporting the upper end 22*a* of the spring steel material 22. A contact surface 28*a* following the shape of the lower end 22*b* of the spring steel 22 is formed in the jig 28. The jig 28 is driven vertically by a hydraulic system 34. The hydraulic system 34 has a cylinder 30 and a piston rod 32 that moves back and forth with respect to the cylinder 30. The jig 28 is attached to a tip end of the piston rod 32. The jig 42 has the same configuration as the jig 28. In other words, the jig 42 has a contact surface 42*a* following the shape of the upper end 22*a* of the spring steel material 22 and is driven vertically by a hydraulic system 40 having a cylinder 36 and a piston rod 38. By supporting either end of the spring steel material 22 with the jigs 28 and 42, the spring steel material 22 can accurately be placed in a desired position.

Note that the spring steel material 22 can be electrically heated by the above-described electrical heating device in the following procedure. First, the clamping mechanism (24*b*, 26*b*) and the jig 28 are retracted downward. Next, the spring steel material 22 is installed to the jig 42 by using a robot hand that is not shown. In other words, the robot hand is driven until the upper end 22*a* of the spring steel material 22 comes into abutment with the jig 42, and accordingly the spring steel material 22 is positioned with respect to the jig 42. At the same time, the clamping mechanism (24*a*, 26*a*) clamps the upper end 22*a* of the spring steel material 22. Subsequently, the jig 28 and the clamping mechanism (24*b*, 26*b*) are moved upward, and thereafter the clamping mechanism (24*b*, 26*b*) clamps the lower end 22*b* of the spring steel material 22. Once the upper end 22*a* and the lower end 22*b* of the spring steel material 22 are clamped, the power unit 50 applies a voltage between the upper end and the lower end of the spring steel material 22 to supply power to the spring steel material 22. As a result, the spring steel material 22 is heated. When this electrical heating of the spring steel material 22 is ended, the clamping mechanism (24*b*, 26*b*) releases the lower end 22*b* of the spring steel material 22, and thereafter the jig 28 and the clamping mechanism (24*b*, 26*b*) are retracted downward. Then, while the robot hand, not shown, grabs the spring steel material 22, the clamping mechanism (24*a*, 26*a*) releases the upper end 22*a* of the spring steel material 22, and thereafter the robot hand conveys the spring steel material 22 to the outside of the device.

Note that the heat caused by electrically heating the spring steel material 22 deforms the spring steel material 22. In the present embodiment, while the clamping mechanism (24*b*, 26*b*) moves in the vertical direction, the clamping mechanisms (24*a*, 26*a*), (24*b*, 26*b*) rotate around the axis of winding of the spring steel material 22, in response to the deformation of the spring steel material 22. Consequently, the thermal deformation of the spring steel material 22 is absorbed.

Subsequent to the execution of the above-described heat treatment, a surface of the spring steel material is subjected to shot peening (S14 shown in FIG. 1). In this step, compressive residual stress is applied to the surface of the spring steel material, improving the durability of the suspension coil spring. Furthermore, a surface oxide scale formed on the surface of the spring steel material in the heat treatment step of step S12 is removed, thereby achieving better coating adhesion.

Next, the spring steel material is heated after the shot peening (S16). This improves the setting resistance of the suspension coil spring. In this heating treatment, the surface of the spring steel material is heated to a predetermined set temperature (e.g., 190 to 300° C.). Note that various heating methods can be employed in this heating treatment, examples of which include high-speed hot-air heating (wind speed: 10 m/s or higher), induction heating, infrared heating, and electrical heating.

After heating the spring steel material in step S16, the spring steel material is cooled naturally, and a coating is sprayed onto the surface of the spring steel material (S18). When spraying the coating onto the surface of the spring steel material, for example, spray coating can be employed where the coating is atomized and then sprayed with high-pressure air. Alternatively, the coating can be sprayed electrostatically onto the surface of the spring steel material.

After the end of the spray coating on the surface of the spring steel material, the spring steel material is heated to bake the coating, which is sprayed onto the surface of the spring steel material, onto the surface of the spring steel material (S20). A heating furnace, a heat gun, or the like can be used for heating the spring steel material.

In the method of producing a suspension coil spring according to the present embodiment described above, electrical heating is performed in step S12 to heat the spring steel material at a temperature higher than that of the conventional technology, thereby achieving a reduction in the time required in the heat treatment of step S12. Therefore, the difference between the time required in the forming step of step S10 and the time required in the heat treatment step of step S12 can be reduced. As a result, the number of heat treatment facilities disposed in a production line can be reduced, and suspension coil springs can be produced efficiently.

While specific examples of the present application have been described above in detail, these examples are merely illustrative and place no limitation on the scope of the patent claims. The technology described in the patent claims also encompasses various changes and modifications to the specific examples described above.

For example, the embodiment above has described the example of producing a suspension coil spring; however, the technology according to the present application can be applied to an example of producing a spring other than the suspension coil spring. For example, the technology according to the present application can be used for producing a stabilizer bar, a torsion bar spring, and the like.

In addition, in order to appropriately execute the heat treatment of step S12, the temperature of the surface of the spring steel material may be measured using a non-contact thermometer (e.g., a radiation thermometer, a thermograph), and then the amount of the current applied to the spring steel material and the time for applying the current may be controlled based on the measured surface temperature. In this manner, the temperature of the spring steel material is controlled accurately, and an appropriate amount of heat treatment can be executed on the spring steel material.

Moreover, the embodiment above has described the example in which the electrical heating method of the present application is applied to the heat treatment (low temperature annealing treatment) for removing a machining strain that is generated as a result of forming the spring steel material into a spring shape by cold or warm working. However, the technology disclosed in the present specification is not limited to this example. For instance, the electrical heating method disclosed in the present specification can be applied to a heat treatment step (tempering treatment) that is performed after forming the spring steel material into a spring shape by the hot working and then quenching the formed spring steel material.

The technical elements explained in the present description or drawings provide technical utility either independently or through various combinations. The present invention is not limited to the combinations described at the time the claims are filed. Further, the purpose of the examples illustrated by the present description or drawings is to satisfy multiple objectives simultaneously, and satisfying any one of those objectives gives technical utility to the present invention.

The invention claimed is:

1. A method of producing a coil spring, the method comprising:

a forming step of forming a spring steel material into a shape of a coil spring;

a first clamping step of clamping one end of the spring steel material formed into the shape of the coil spring by a first electrode;

a second clamping step of clamping the other end of the spring steel material formed into the shape of the coil spring by a second electrode; and a heat treatment step of eliminating a machining strain generated in the spring steel material by the forming step by electrically heating the spring steel material by applying a current from the first electrode to the second electrode via the spring steel material, and allowing the first electrode to move in an axial direction of the shape of the coil spring and to rotate around an axis of the shape of the coil spring with respect to the second electrode clamping the other end of the spring steel material during the heat treatment step to thereby eliminate the machining strain;

wherein the heat treatment step comprises a first step of heating the spring steel material to a predetermined set temperature, and a second step of keeping the spring steel material at the set temperature for a predetermined set time period subsequent to the first step, the set temperature is set to be higher than 430° C. but not higher than 500° C.

2. The method of producing a spring according to claim 1, wherein the set temperature is set such that time required in the first and second steps is 1 minute or less and the set time period is 5 seconds or more.

3. The method of producing a spring according to claim 2, wherein, in the heat treatment step, a temperature of the spring steel material is measured and an amount of the current applied to the spring steel material and time required in the application of the current are controlled based on the measured temperature.

4. The method of producing a spring according to claim 1, wherein, in the heat treatment step, a temperature of the spring steel material is measured and an amount of the current applied to the spring steel material and time required in the application of the current are controlled based on the measured temperature.

* * * * *